United States Patent [19]

Izumihara

[11] 4,264,394

[45] Apr. 28, 1981

[54] THERMAL STAMPING DEVICE

[75] Inventor: Hiroshi Izumihara, Gose, Japan

[73] Assignee: Taihei Industries Co., Ltd., Osaka, Japan

[21] Appl. No.: 96,866

[22] Filed: Nov. 23, 1979

[30] Foreign Application Priority Data

Dec. 18, 1978 [JP] Japan ..... 53-156716
Dec. 18, 1978 [JP] Japan ..... 53-156717

[51] Int. Cl.[3] ..... G05G 15/00

[52] U.S. Cl. ..... 156/358; 101/7; 101/25; 101/38 R; 156/361; 156/540

[58] Field of Search ..... 156/358, 361, 350, 351, 156/540–542; 101/4–8, 38 R, 38 A, DIG. 3, 22–23, 25, 36

[56] References Cited

U.S. PATENT DOCUMENTS 3,640,213 2/1972 Schwartzbach ..... 101/38 R
3,692,611 9/1972 Kühnle ..... 156/358
4,010,681 7/1980 Hamberger ..... 101/38 R
4,194,944 3/1980 Spätle ..... 101/38 R

*Primary Examiner*—David A. Simmons
*Attorney, Agent, or Firm*—Griffin, Branigan & Butler

[57] ABSTRACT

A device for heating and transferring a film to the surface of an object having a variable transfer width wherein the object is mounted on a rotary jig and a thermal transfer roll contacts the object so that the film is fed between the transfer roll and the object as the jig rotates. In order to prevent excessive transfer pressures, the contact pressure exerted by the transfer roll on the surface of the object can be varied with reference to changes in the width of the surface to which the film is actually applied. In lieu of varying the pressure, the speed at which the transfer rolls traverses the surface can be adjusted with respect to variations in the width of the surface to which the film is transferred.

5 Claims, 4 Drawing Figures

THERMAL STAMPING DEVICE

BACKGROUND OF THE INVENTION

This invention broadly relates to a thermal stamping device for transferring a film from a carrier web to the surface an object and more particularly to a thermal stamping device capable of continuously and uniformly applying a film despite variations in the width of the surface to which the film is applied.

Thermal of hot stamping devices are known for continuously transferring a film from a carrier web to the outer surface of an object by utilizing a heated transfer roll which presses the film against the object while simultaneously activating a heat sensitive adhesive capable of attaching the film to the surface.

Uniform transfer of the film requires that the transfer roll traverse the object at a constant transfer pressure and speed. Prior art thermal stamping devices are known, such as disclosed by the inventor of the present application in Japanese patent publication No. 9124/78, which include a pressure control system for detecting and maintaining a constant total transfer pressure; a speed control system for detecting and maintaining a constant transfer speed; and an automatic arrangement for eliminating any detected deviation from the reference transfer pressure and speed.

One disadvantage of this prior art device is the inability to vary either the total transfer pressure or the transfer speed with respect to changes in the actual width of the surface to which the film is applied. Since the pressure control system of the above-noted prior art device is directed to controlling the entire transfer pressure imposed by the transfer roll on the whole width of the object to be stamped, the system is incapable of controlling the transfer pressure per unit width actually stamped.

This drawback causes problems when stamping a product like that illustrated in FIGS. 1 and 3 where a surface PS of an object G is provided with windows R1, R2, and R3. If the entire surface PS of the object G is stamped with a film transferred from a carrier web, it can be seen that the actual transfer width for distances I, III and V is equal to the entire width W of the object G, whereas the actual transfer width for distance II is (W−a) where a is the width of window $R_1$, and the actual transfer width for distance IV is (W−b−c) where b equals the width of window $R_2$ and c equals the width of window $R_3$. If the entire transfer pressure required for uniform stamping is calculated for distances I, III and V and used as the reference pressure, the transfer pressure per unit width actually stamped for distances II and IV becomes excessive resulting in the non-uniform transfer of the film. On the other hand, if the transfer pressure required for distances II or IV is calculated and utilized as the reference pressure, the transfer pressure per unit width actually stamped for distances I, III and V becomes insufficient for uniform stamping.

SUMMARY

Accordingly it is an object of this invention to provide an improved thermal stamping device wherein the entire transfer pressure exerted by a transfer roll upon a surface to be stamped can be varied in accordance with changes in the actual width of the transfer receiving surface so that the transfer pressure per unit width is maintained constant.

A further object of the present invention pertains to an improved thermal stamping device wherein the transfer speed at which a transfer roll traverses a surface may be adjusted with regard to variations in the actual width of the transfer receiving surface thereby avoiding excessive transfer pressures.

In accordance with the principles of the present invention, a thermal transfer device comprises a thermal transfer roll adapted to contact the surface of an object mounted on a rotary jig so that a carrier film including a stamp film may be fed between the transfer roll and the object as the jig rotates under the control of a speed control system having a speed detector. The thermal transfer roll includes an arrangement for moving the roll into contact with the object under the control of a pressure control system having a pressure detector. Also included is a pressure varying system comprising a controller having a transfer position detector and a data storage arrangement for storing data relating to pressure varying commands programmed with respect to changes in the actual transfer width of the surface. Pressure control commands issued by the pressure control system can be varied by pressure modifying commands issued by the pressure varying system. Further, in lieu of varying the transfer pressure, the thermal stamping device may include a speed varying system comprising a controller having a transfer position detector and a data storing arrangement programmed with respect to changes in the actual transfer width of the surface stamped so that speed commands issued by the speed control system can be modified by speed varying commands from the speed varying system.

BRIEF DESCRIPTION OF THE DRAWINGS

The foregoing and other objects, features, and advantages of the invention will be apparent from the following more particular description of preferred embodiments of the invention, as illustrated in the accompanying drawings. The drawings are not necessarily to scale, emphasis instead being placed on illustrating the principles of the invention.

DETAILED DESCRIPTION

Figure 3:
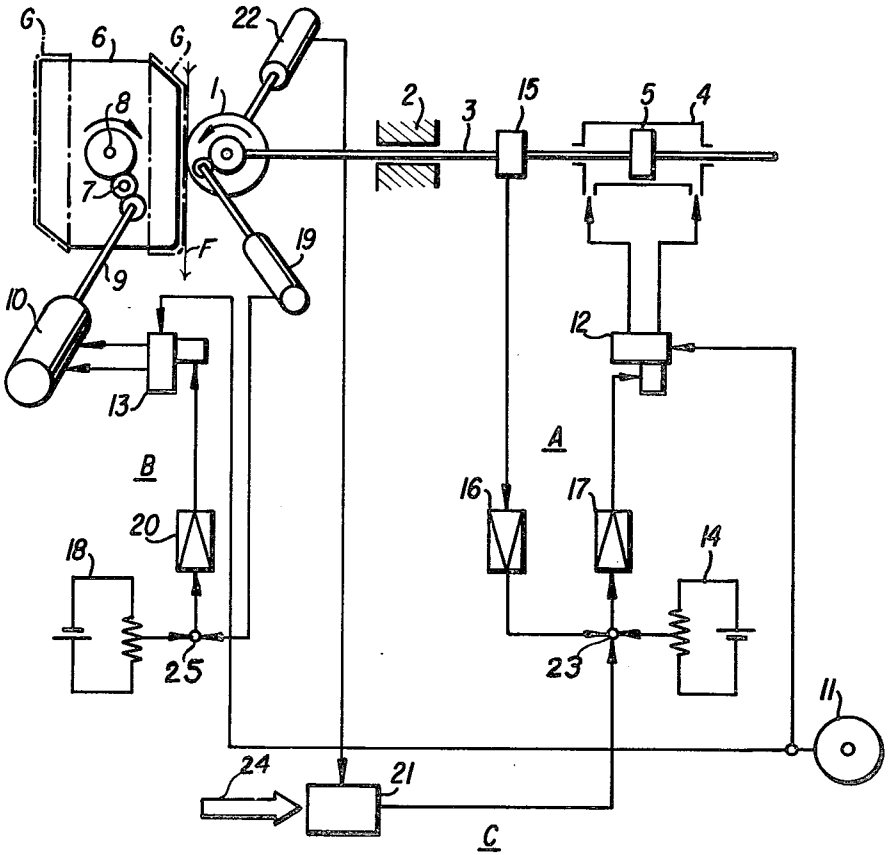
FIG. 3 illustrates an embodiment of the present invention capable of varying the transfer pressure with respect to changes in the actual transfer width of the surface to be stamped; and, FIG. 4 illustrates a further embodiment of the present invention wherein the transfer speed may be varied in accordance with changes in the actual width of the surface to be stamped.

The thermal stamping device pictured in FIG. 3 includes a thermal transfer roll 1 rotatably mounted at the extremity of a support frame 3 adapted to move back and forth along guide members 2. The transfer roll 1 is heated by an appropriate heat source (not shown) and may be constructed from a heat resistant and resilient material such as silicone rubber.

Figure 1:
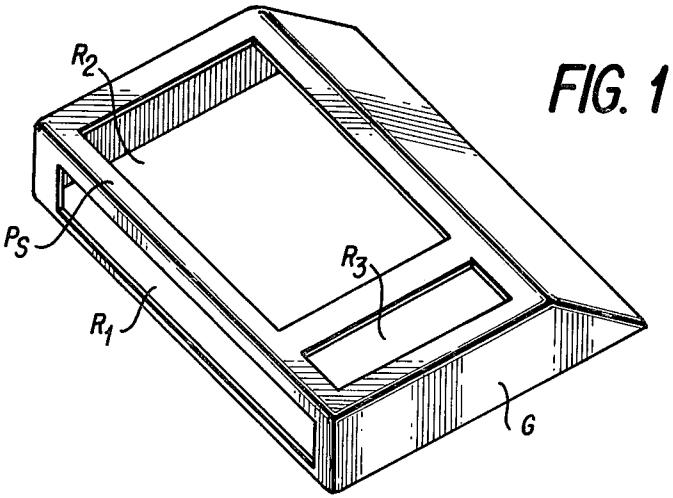
FIG. 1 is a perspective view of an object having a variable, actual transfer width.
Figure 2:
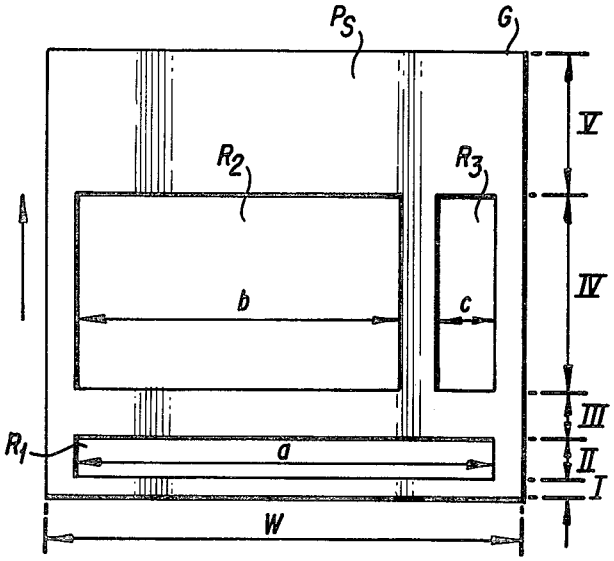
FIG. 2 is a top, planar view of the outer surface of the object illustrated in FIG. 1.

An oil pressure cylinder 4 having a piston 5 attached to the support frame 3 is utilized to urge the transfer roll 1 against a film F to press the film against the surface PS of an object G like that illustrated in FIGS. 1 and 2.

A rotary jig 6 rotatably supports the object G and, as seen in FIG. 3, two of the objects G may be simultaneously mounted on the rotary jig 6 so that their outer surfaces PS can be contacted by the transfer roll 1. Jig 6 is mounted on a rotatable drive shaft 8 which is driven by a drive mechanism 7 interposed between shaft 8 and a driving shaft 9. Shaft 9 is driven by any suitable means such as a fluid motor 10.

A source 11 provides a suitable source of oil pressure which is delivered to servo-valve 13 with the output of the valve controlling the speed of motor 10. Source 11 also supplies pressure to a servo-valve 12 having its outputs connected to cylinder 4 at opposite sides of piston 5 so as to control the pressure applied to object G by the transfer roll 1.

A pressure control system A controls the pressure delivered by servo-valve 12 to the chamber 4. The pressure control system A comprises a pressure command circuit 14 for setting a reference transfer pressure P, a pressure detector 15, a strain amplifier 16, and a servo-amplifier 17. The pressure detector 15 can include a load cell or the like which detects the actual transfer pressure exerted on rod 3 and the servo-amplifier 17 regulates the servo-valve 12 by comparing (i.e. summing at junction 23) the reference pressure commanded by circuit 14 with the detected pressure sensed by the pressure detector 15 so that the transfer roll 1 is urged into contact with the surface PS at a pressure predetermined by the setting of command circuit 14.

A speed control system B governs the pressure delivered through servo-valve 13 to the motor 10 and comprises a speed command circuit 18 for establishing a transfer speed set point, a speed detector 19 including a tachogenerator or the like for detecting the actual transfer speed of transfer roll 1, and a servo-amplifier 20 which regulates servo-valve 13 by comparing the commanded value issued by the speed command circuit 18 with the detected value sensed by the speed detector 19. It will be understood that the transfer roll 1 can be rotated at a pre-determined, constant speed by system B because the transfer roll is in rolling contact with film F which is fed between the work G and the transfer roll by rotation of the jig 6.

Since the pressure control system A is adapted to regulate the entire transfer pressure exerted by the transfer roll on the whole width of the surface PS, the system A alone is incapable of controlling the transfer pressure per unit width actually stamped. Therefore, in addition to the pressure control system A, there is provided a pressure modifying system C including a controller 21 for providing pressure modifying commands in accordance with changes in the actual transfer width of the surface PS to be stamped, and a transfer position detector 22 for acknowledging the advancement of the stamping operation. The controller 21 issues pressure modifying commands which vary the pressure commands issued by the pressure control system A to the servo-amplifier 17.

The pressure modifying commands are issued by the controller 21 in accordance with the distance travelled by the transfer roll 1 as sensed by the position detector 22. The position detector 22 can take the form of a shaft encoder capable of producing electrical pulses in accordance with the angular rotation of transfer roll 1.

Referring to FIGS. 1 and 2, assume the optimum transfer pressure exerted on surface PS when traversed by the transfer roll 1 in the arrow direction is pressure P1 for distance I, pressure P2 for distance II, pressure P3 for distance III, pressure P4 for distance IV and pressure P5 for distance V. If the optimum transfer pressure required for uniform transfer of a film to the entire width W of the surface PS is defined as P, then the respective transfer pressures P1–P5 for the corresponding distances can be determined as a function of the actual transfer width as seen below:

$P1=P$; $P2=P(W-a)/W$; $P3=P$; $P4=P(W-b-c)/W$; $P5=P$.

Once the optimum transfer pressure for each distance along surface PS in the arrow direction has been calculated, this data may be inputted to, or stored in, the controller 21 as indicated at 24, so that pressure modifying commands are issued in accordance with the transfer position sensed by detector 22 as the transfer roll 1 traverses the surface PS.

In operation, the objects G are supported on the rotary Jig 6 as shown in FIG. 3 and rotated by the motor 10 as the transfer roll 1 is driven into contact with the surface PS by the oil pressure cylinder 4 so that the transfer roll 1 is rotatably driven while in contact with the surface PS as the jig rotates. The actual transfer pressure imposed by roll 1 can be regulated by the pressure command circuit 14 of system A. As a result, the servo-valve 12 controls the operation of the oil pressure cylinder 4 in response to pressure command values issued by circuit 14. The actual transfer pressure exerted by the roll 1 is detected by the pressure detector 15 to provide feedback control of the servo-valve 12 via strain amplifier 16 so that the servo-amplifier 17 nullifies any deviation from the initially desired reference pressure P.

Since the transfer speed is equal to the circumferential speed of the transfer roll 1, the transfer speed is determined by the rate at which the object G revolves and the radius of the transfer roll 1 while in a contact position with the outer surface of object G. During the transfer operation, the speed control system B maintains the transfer speed at a constant value utilizing the speed command circuit 18 adapted to issue commands to the servo-valve 13 which controls the motor 10. The actual transfer speed is detected by speed detector 19 to provide feedback control via servo-amplifier 20 thereby establishing and maintaining an initially desired transfer speed.

As the transfer roll 1 traverses distance I of surface PS, the controller 21 issues and directs to the pressure control system A a pressure modifying command which, when combined with the reference pressure commanded by circuit 14 results in servo-valve 12 outputting to cylinder 4 a pressure such that roller 1 acts against film F with a pressure $P_1$. If the reference pressure determined by the setting of circuit 14 is P, then the pressure modifying command from controller 21 while transfer roll 1 traverses distance I is zero.

When the stamping operation onto surface PS has advanced from distance I to distance II, this advance is sensed by the transfer position detector 22 and controller 21 issues a new pressure modifying command. Since the actual width of the surface to be stamped for distance II is less than that for distance I, a pressure modifying command is again initiated by the controller 21 and directed to the pressure control system A so that a reduced actual transfer pressure P2 is exerted. Similarly, this operation is carried out for distances III, IV, and V such that the controller 21 issues pressure modifying commands to the pressure control system A so that the actual pressure exerted by the transfer roll 1 equals P3, P4 and P5 for each of the distances, respectively.

Since the actual transfer pressures P1–P5 are determined as a function of the actual width of the surface to be stamped, the transfer pressure per unit width actually stamped becomes $P1'=P2'=P3'=P'=P5'=P/W$. Therefore, the transfer pressure per unit width actually stamped can be constantly maintained from beginning to end even when the actual tranfer width of the surface PS varies.

Figure 4:
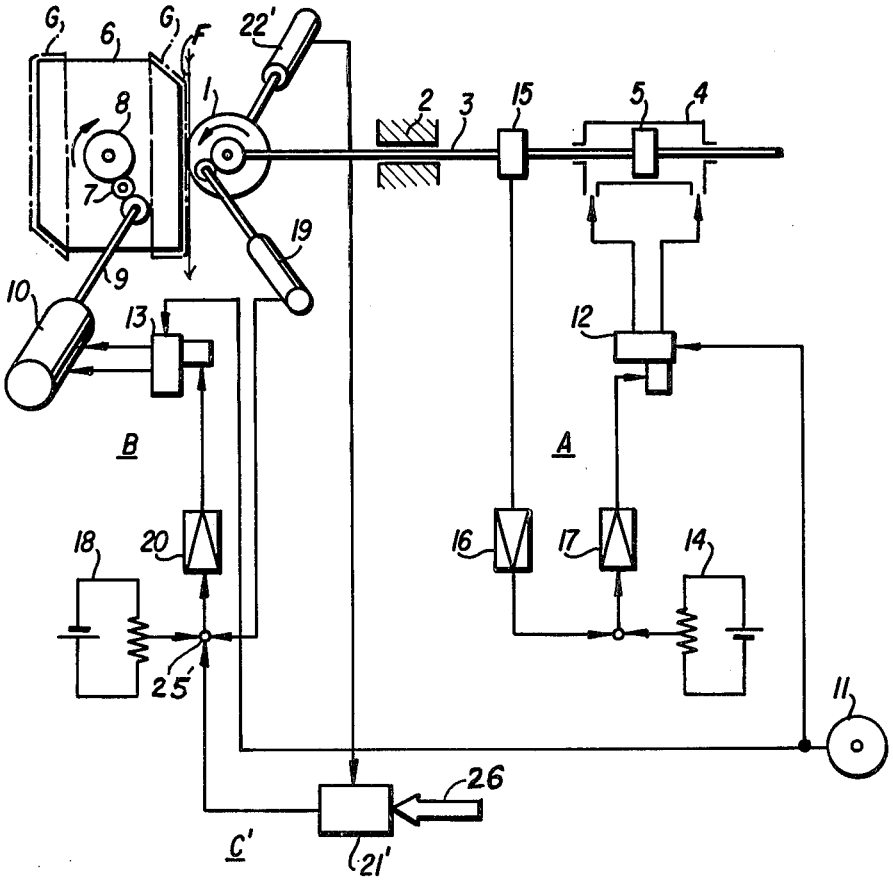

Referring to FIG. 4, an alternative embodiment of the present invention is illustrated wherein the speed control system B is provided with a speed modifying system C' comprising a controller 21' adapted to issue speed modifying commands in response to variations in the actual transfer width of the surface to be stamped and a transfer position detector 22', such as a shaft encoder, for acknowledging the advancement of the transfer operation.

The controller 21' issues speed modifying commands to summing junction 25' of the speed control system so that the transfer roll 1 traverses the surface PS at a speed S1 for distance I, speed S2 for distance II, speed S3 for distance III, speed S4 for distance IV, and speed S5 for distance V. If one assumes that the optimum transfer speed for the entire transfer width W of the surface PS is defined as S, then the transverse speeds S1–S5 for the corresponding distances can be determined as a function of the actual transfer width as follows:

$S1=S$; $S2=SW/(W-a)$; $S3=S$; $S4=SW/(W-b-c)$; $S5=S$.

The values for transfer speeds S2 and S4 may be determined at a lower value than the foregoing equations depending upon the thermal conductivity of the film carrier and film.

Once the optimum transfer speed has been determined for each distance in regard to the variations in the actual transfer width of the surface PS to be stamped, this data is inputted to the controller 21' as schematically illustrated at 26. The transfer position detector 22' senses the distance travelled along the surface PS during the stamping operation and relays this information to the controller 21' which issues speed modifying commands to the speed control system B in accordance with the optimum transfer speed calculated. It should be noted that the entire transfer pressure exerted by the transfer roll 1 during this operation is maintained constant.

In operation, the speed modifying system C' varies the reference transfer speed established and maintained by the speed control system B in accordance with changes in the actual transfer width of the surface to be stamped. Accordingly, when the transfer operation is carried out for distance I a speed modifying command is issued to the speed control system B so that a transfer speed S1 is maintained. When the transfer operation has progressed from distance I to II this advance is detected by the transfer position detector 22' and a speed modifying command is issued by controller 21' and directed to the speed controlling system B so that an actual transfer speed of S2 is maintained for the distance II. Accordingly, this operation is continued for distances III, IV and V resulting in speed modifying commands S3, S4 and S5, respectively, which are outputted by the controller 21' and directed to the speed control system B.

Since the transfer speeds S1–S5 are determined as a function of the actual transfer width of the surface to be stamped, it follows that the smaller the actual transfer width is, the greater the transfer speed allowable. As a result, the transfer roll 1 contacts the surface PS for a shorter period of time while traversing that portion of the surface PS having a reduced width thereby shortening the intervals of time during which the film is subjected to excessive transfer pressure.

While the invention has been particularly shown and described with reference to a preferred embodiment thereof, it will be understood by those skilled in the art that various changes in form and detail may be made therein without departing from the spirit and scope of the invention. For example, the hydraulic systems utilized to maintain a constant speed and pressure may be replaced by servo motors or the like.

The embodiments of the invention in which an exclusive property or privilege is claimed are defined as follows:

1. A device for heating and transferring a film to the outer surface of an object having a variable width surface to which said film is transferred, said device comprising:
   - a rotatable jig means for rotatably supporting said object;
   - a heated transfer roll for heating said film and pressing it against said variable width surface as said transfer roll rolls along said surface;
   - means movably mounting said heated transfer roll for linear movement toward and away from said variable width surface;
   - means for urging said transfer roll into contact with said film including a pressure control system for normally maintaining a predetermined transfer pressure of said roll against said film;
   - means for driving said jib means including a speed control system for normally maintaining a predetermined transfer speed of said roll; and,
   - controller means for varying the application of pressure to said film by said transfer roll in accordance with variations in the width of the variable width surface to which said film is transferred, said controller means including a transfer position detector means for determining the actual distance travelled along said surface by said transfer roll.

2. A device as claimed in claim 1 wherein said controller means varies the magnitude of the pressure applied to said film by said transfer roll, said controller means having means for storing data relating to pressure moderating commands programmed for respective distances travelled by said roll along said surface, said means for storing data being responsive to said position detector means for applying pressure moderation signals to said pressure control system.

3. A device as claimed in claim 1 wherein said controller means varies the duration of time said predetermined pressure is applied to said film by said transfer roll, said controller means having means for storing data relating to speed moderating commands programmed for respective distances travelled by said roll along said surface, said means for storing data being responsive to said position detector means for applying speed moderation signals to said speed control system.

4. A device as claimed in claim 3 wherein said pressure control system includes:
   - means for generating a command representing said predetermined pressure;

means for sensing the actual pressure of said transfer roll against said film, and producing an actual pressure signal; and summing means responsive to said actual pressure signal and the command representing said predetermined pressure for applying pressure to the means urging the transfer roll into contact with said film, said pressure moderation signals from said controller being applied to said summing means.

5. A device as claimed in claim 4 wherein said means for driving said jig includes a motor and said speed control system includes:

means for generating a command representing said predetermined speed;

means for sensing the speed of said transfer roll and producing a speed signal; and summing means responsive to said speed signal and said command representing said predetermined speed for controlling said motor, said speed moderation signals from said controller means being applied to said summing means.

* * * * *